United States Patent [19]

Scarnera et al.

[11] Patent Number: 4,721,086

[45] Date of Patent: Jan. 26, 1988

[54] SYSTEM FOR CONTROLLING FUEL INJECTORS TO OPEN ASYNCHRONOUSLY WITH RESPECT TO THE PHASES OF A HEAT ENGINE

[75] Inventors: Michele Scarnera, Monzuno; Franco Ciampolini, Bologna, both of Italy

[73] Assignee: Weber S.p.A., Turin, Italy

[21] Appl. No.: 860,066

[22] Filed: May 6, 1986

[30] Foreign Application Priority Data

May 10, 1985 [IT] Italy ..... 67429 A/85

[51] Int. Cl.[4] ..... F02M 51/00

[52] U.S. Cl. ..... 123/478; 123/490; 123/496; 123/480

[58] Field of Search ..... 123/478, 496, 480, 472, 123/473, 491, 179 G, 179 L; 361/154; 367/155

[56] References Cited

U.S. PATENT DOCUMENTS

| | | | |
|---|---|---|---|
| 4,528,960 | 7/1985 | Miznoro et al. | 123/490 |
| 4,572,142 | 2/1986 | Arnold et al. | 123/478 |
| 4,582,035 | 4/1986 | Kishi | 123/490 |
| 4,604,675 | 8/1986 | Pfladerar | 361/155 |
| 4,605,983 | 8/1986 | Harvey | 361/154 |
| 4,656,989 | 4/1987 | Yakuwa | 123/490 |
| 4,681,077 | 7/1987 | Kobnyashi et al. | 123/491 |

*Primary Examiner*—Raymond A. Nelli

*Attorney, Agent, or Firm*—Gifford, Groh, VanOphem, Sheridan, Sprinkle and Dolgorukov

[57] ABSTRACT

A control system for at least one fuel injector in an electronic fuel injection system for a heat engine in which the injector has a linear operating time range defined by a minimum opening time (MIT) and a minimum rest time (MIOT). The system includes a first processor for determining a theoretical injector opening time (TJ), and a second processor directing asynchronous opening of the injector with respect to the phase of the engine, subject to the criteria that the minimum opening and rest times are maintained, while the same linear proportion between the opening and closing time of the injector is also maintained, to ensure that the operating time does not exceed this linear range.

8 Claims, 4 Drawing Figures

SYSTEM FOR CONTROLLING FUEL INJECTORS TO OPEN ASYNCHRONOUSLY WITH RESPECT TO THE PHASES OF A HEAT ENGINE

BACKGROUND OF THE INVENTION

I. FIELD OF THE INVENTION

The present invention relates to a system for controlling the opening times of fuel injectors in an electronic fuel injection system for a heat engine.

II. DESCRIPTION OF THE PRIOR ART

As is known, in electronic fuel injection systems for heat engines there is an electronic control unit which, in dependence on signals which it receives from various sensors (principally the revolution counter sensor, the sensor detecting the phase of the engine, and sensors detecting the intake manifold pressure and intake air temperature), determines, for example, the density of the air in the induction manifold (i.e., intake manifold pressure) and the speed of revolution of the engine, and calculates the timing and duration of injection of fuel to the injectors, and the ignition advance, based upon tabulated values in a computer memory. Such injectors can be individually provided for each cylinder, disposed downstream of the butterfly valve, or can be provided as a single injector located either upstream or downstream of the butterfly valve. The quantity of fuel delivered to each injector at each opening cycle is therefore variable within wide limits depending on the operating conditions of the engine. Moreover, it must be observed that, as can be seen from FIG. 2, the characteristic curve which relates the opening time of the injector and the quantity of fuel delivered through the injector itself is substantially linear in only a central section lying between the opening times A and B, and that the linearity is not guaranteed for shorter times (less than MIT, defined as the minimum acceptable injection time) and for very small rest periods of the injector between successive operating periods (less than MIOT, the minimum acceptable injector closure time, defined with respect to the repetition period of operation PI). The quantity IOT is the intrinsic delay time of the injector, dependent on the supply voltage. Thus, when the central control unit determines an injector operating time outside the range of linearity, the operating conditions of the system become inefficient.

SUMMARY OF THE INVENTION

The object of the present invention is that of providing a system for controlling the operating times of a fuel injector in an electronic fuel injection system for a heat engine which overcomes the above indicated disadvantages, that is to say which allows achievement of a high variability of the flow rate of fuel delivered by the injector, whilst still guaranteeing operation of the injector itself in such a linear zone.

According to the present invention there is provided a system for controlling at least one fuel injector in an electronic fuel injection system for a heat engine, the injector having an operating time interval defined by a minimum opening time (MIT) and a minimum rest time (MIOT). The system comprises a first processor means for determining a theoretical opening time (TJ) of the injector, and is characterized by the fact that it includes a second means for providing asynchronous opening of the injector with respect to the phases of the engine to ensure that the operating time does not exceed the interval, that is, to ensure that the minimum opening and rest times are maintained.

BRIEF DESCRIPTION OF THE DRAWINGS

For a better understanding of the present invention a particular embodiment is now described, purely by way of nonlimitative example, with reference to the attached drawings, in which.

DETAILED DESCRIPTION OF THE INVENTION

Figure 1:
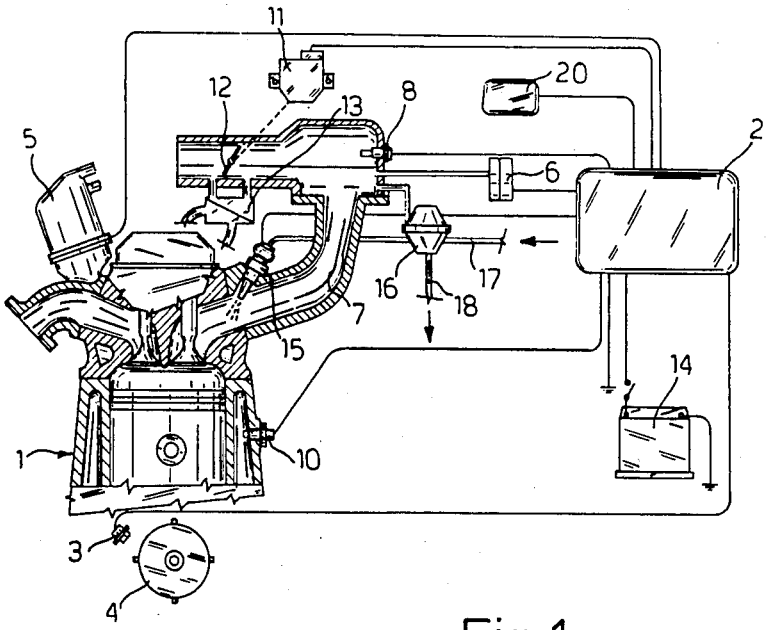
FIG. 1 is a schematic view of an electronic fuel injection system for a heat engine incorporating the control system of the present invention.

With reference to FIG. 1, there is schematically shown an electronic fuel injection system for a heat engine 1, only partly shown, in section. This system includes an electronic control unit 2 comprising, in a substantially known way, a microprocessor and readable memories containing tabulated values relating to various operating conditions of the engine 1. This control unit 2 receives signals from:

- a sensor 3 detecting the speed of rotation of the engine 1, disposed opposite a pulley 4 keyed to the crankshaft of the engine 1;
- a device 5 sensitive to the phase of the engine 1;
- a sensor 6 for detecting the absolute pressure existing in an induction manifold 7 of the engine 1;
- a sensor 8 for detecting the temperature of the air in the manifold 7;
- a sensor 10 for detecting the temperature of the water in the cooling jacket of the engine 1; and
- a sensor 11 for detecting the position of a butterfly 12 disposed in the induction manifold 7 and controlled by the accelerator pedal. In parallel with this butterfly valve 12 there is disposed a valve 13 for the induction of supplementary air.

This electronic control unit 2 is also connected to a battery 14 for electrical supply, and to ground. In dependence on the signals from the sensors, the values for the operating conditions of the motor and the intake pressure are utilized to determine the quantity of fuel required to achieve a desired horsepower level. This control unit 2 controls the opening time of the electroinjectors 15 disposed in the manifold 7 to control the quantity of fuel provided to the various cylinders of the engine 1, and to control the timing of the injection and the commencement of the delivery of fuel dependent upon the phase (induction, compression, expansion and exhaust) of the engine 1. A single injector 15 can be provided for all the various cylinders of the engine 1, or else there can be provided several injectors, one for each cylinder; in the second case, the control unit 2 controls the time and phasing of opening of the injectors 15 in such a way that a quantity of fuel is provided to each cylinder of the engine 1 in a sequential manner (1-3-4-2) in a single delivery, with initiation of the delivery of fuel related to the induction of each cylinder. Each injector 15 is supplied with fuel through a pressure regulator 16 sensitive to the pressure in the induction manifold 7 and having a fuel inlet duct 17 leading from a pump (not illustrated) and a duct 18 leading back to a reservoir (not illustrated). The electronic central control unit 2 is moreover connected to a unit 20 for controlling the ignition pulses (provided to the various cylinders through the distributor).

For purpose of illustration, however, it will be presumed that the engine 1 includes a single electrically operated injector 15 present in the induction manifold 7 for providing fuel to all the cylinders of the engine 1. The central control unit 2 determines for each phase of the engine 1 the opening time (TJ) of the injector 15 as is shown in FIG. 3, in which the line a represents the perodic signals corresponding to the phase of the engine 1, having a repetition period PI, and the line b represents the signals for controlling opening of the electrical injector 15, having a duration TJ starting from each phase signal and repeated at each period PI. When TJ falls between times A and B in FIG. 2, that is, when injection response is linear, engine operation is satisfactory with an injector open time of TJ and a period of repetition of PI.

Figure 3:
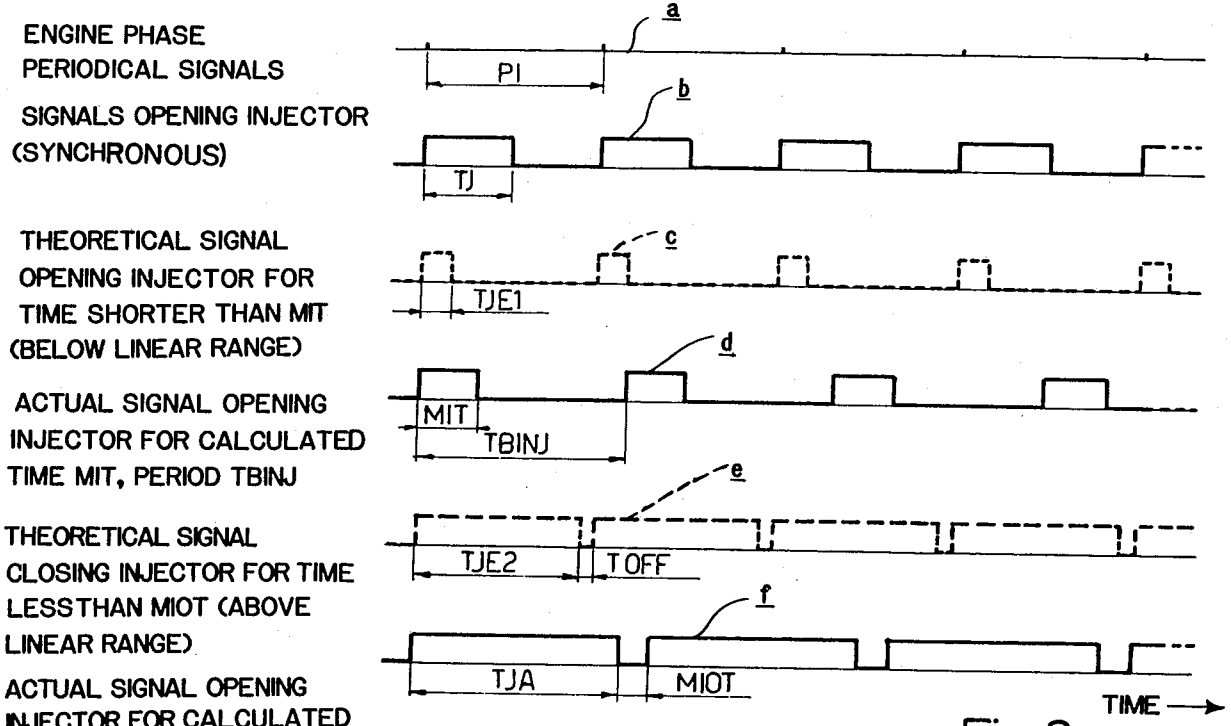
FIG. 3 illustrates, in schematic form, control signals supplied to the injector under various operating conditions according to the control system of the present invention.
Figure 4:
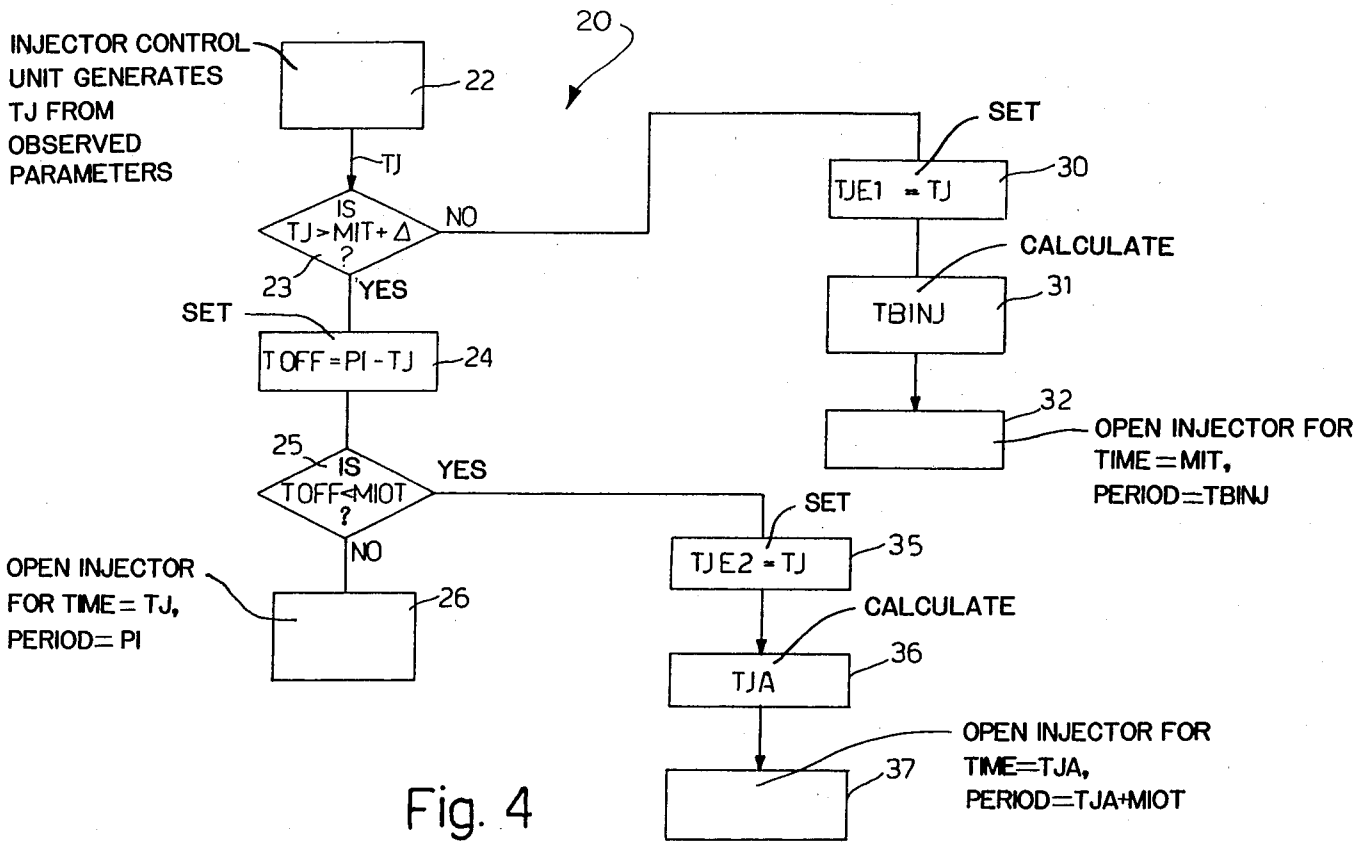
FIG. 4 is a block diagram of the operation of the control system of the present invention.

The automatic operation directed by the electronic central control unit 2 is illustrated in FIG. 4, in which a unit 22 of the central control unit 2 determines, in dependence on the input parameters first specified, the theoretical opening time TJ of the electrical injector 15. The value TJ is then passed to a block 23 which evaluates whether TJ is greater than MIT plus Δ, that is to say the minimum opening time of the injector increased by a quantity of hysteresis of the control system. If TJ is greater than MIT plus Δ(supposing the TJ corresponds to the time C in FIG. 2), a block 24 calculates the time for which the injector should remain closed; that is to say, TOFF=PI−TJ. From the block 24 a signal passes to a block 24 which calculates whether this closure time (TOFF) is less than the minimum rest time of the injector MIOT; if not, as for the time C of FIG. 2, a block 26 controls the opening of the injector 15 for the time TJ at each period PI such that the injector 15 is open in synchrony with the phase of the engine 1 (line b of FIG. 3).

On the other hand, if the opening time of the injector 15 (determined by the block 22, in dependence on the particular operating conditions of the engine 1) is less than the minimum operating time (MIT) for linear operation of the injector (line c of FIG. 3), the block 23 (FIG. 4) leads to a block 30 which sets a calculated opening time TJE1=TJ. A block 31 then calculates an equivalent time period (TBINJ) for periodic activation of the electrical injector 15, which is asynchronous with respect to the period PI of the phases of the engine. TBINJ, as calculated by the block 31, is subject to the criteria that the electrical injector 15 is maintained open at least for the minimum admissable injection time (MIT), while the same linear proportion between opening time and closure time of the electrical injector 15 in asychronous operation (line d of FIG. 3) as in (theoretical) synchronous operation (line e of FIG. 3) is maintained. These criteria are met by setting:

$$\frac{TJE1 - IOT}{PI} = \frac{MIT - IOT}{TBINJ},$$

from which:

$$TBINJ = PI\left(\frac{MIT - IOT}{TJE1 - IOT}\right).$$

In this way, in the calculation of the asynchronous period (TBINJ), the factor IOT (which depends on the voltage of the battery 14) is also taken into account. The block 31 then leads onto a block 32 which controls the opening of the electrical injector 15 for a time MIT each period TBINJ (line d in FIG. 3).

Figure 2:
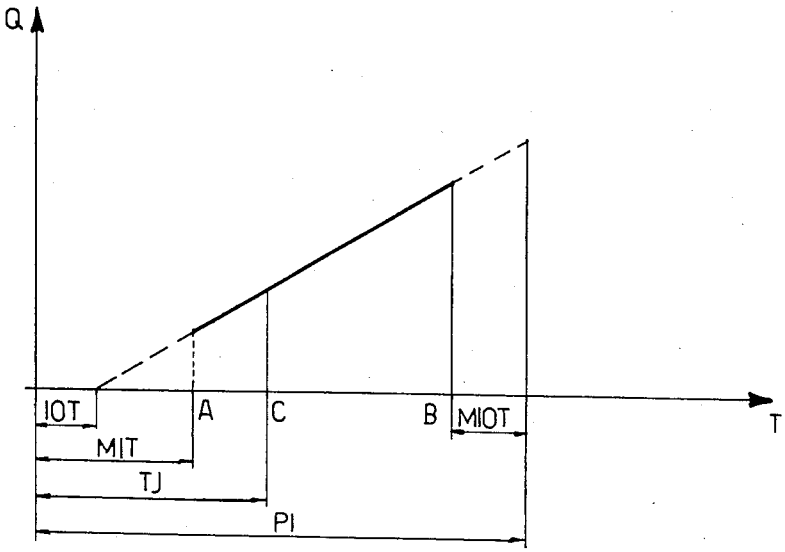
FIG. 2 is a diagram of the operating open time-flow rate for an injector utilized in the injection system of FIG. 1.

If, on the other hand, the injector 15 must theoretically be maintained open for a time so long that the rest time (TOFF) between successive activation periods will be less than the minimum rest time (MIOT), as can be seen in line e of FIG. 3 and in FIG. 2, the block 25 of FIG. 4 leads to a block 35 which sets the calculated opening time TJE2=TJ. The block 35 leads in turn to a block 36 which, based on the same criteria of proportionality between the closure and opening time of the injector 15 in the synchronous and asynchronous operation already illustrated for the operation of the block 31, calculates an injector opening time (TJA) with the closure time preset at the minimum rest time (MIOT) (line f of FIG. 3).

In such a case, these criteria are met by putting:

$$\frac{TJA + MIOT}{PI} = \frac{MIOT + IOT}{PI + IOT - TJE2},$$

from which:

$$TJA = \left(PI\left(\frac{MIOT + IOT}{PI + IOT - TJE2}\right)\right) - MIOT$$

Block 36 is followed by a block 37 which provides the injector 15 with the opening control for the time TJA, and a rest time MIOT, with a repetition period equal to (TJA+MIOT).

With the injector operation control system according to the present invention there is therefore obtained the advantage of being able to make the injector 15 operate within a wide range of operating conditions with the assurance that the injector 15 itself always functions in its linear range and with the assurance that asynchronous operation of the injector 1 with respect to the phase of the engine is calculated in such a way as to have the same functional equivalence (minimum open and rest times) with respect to activation synchronized with the phase of the engine 1.

Finally, it is clear that the described embodiments of the control system of the present invention can have modifications and variations introduced thereto without departing from the scope of the invention itself.

Among other things, the described system can be applied to an installation with a single injector or with a plurality of injectors for the various cylinders, with consequent obvious adaptations to the various repetition periods of operation.

What is claimed is:

1. An electronic fuel injection control system for a heat engine, said engine including at least one fuel injector having a fuel delivery rate which is linear with a periodic opening time of said injector, when said injector opening time lies in a range between a minimum opening time MIT and the difference between an opening period PI and a minimum rest time MIOT; said system comprising:

a first processor means for determining a theoretical opening time TJ of said injector; and a second means for synchronous opening of said injector for a time equal to TJ and a period equal to PI when TJ lies in said range, and for opening said injector asynchronously with said period PI while maintaining an opening time of at least MIT and a rest time of at least MIOT, when TJ lies outside said range.

2. A system according to claim 1, wherein said second means includes a third means for determining whether said injection opening time TJ falls in said range, and for controlling a fourth determining means when said injector opening time TJ does not lie in said range, said fourth means being a means for determining an asynchronous injector operating time and an asynchronous repetition period.

3. A system according to claim 2, wherein said fourth determining means sets said injector opening time at MIT if TJ lies below said range, and sets said injector rest time at MIOT if TJ lies above said range; and thereafter determines said asynchronous repetition period as a function of TJ, PI and one of MIT and MIOT, respectively.

4. A system according to claim 2, wherein said fourth means maintains a constant ratio between TJ; PI; said asynchronous repetition period; and one of MIT and the difference between said asynchronous period and MIOT, when TJ lies below or above said range, respectively.

5. A system according to claim 2, wherein said engine includes an electrical supply battery connected to said system, and said fourth means determines said asynchronous repetition period as a function of the voltage of said battery.

6. A system according to claim 1, wherein said second means is incorporated in said first processor means.

7. A system according to claim 1, wherein said range varies in dependence upon PI.

8. A system according to claim 5, wherein if IOT is a system hysterisis factor taking said battery voltage into account, when TJ lies below said range, said asynchronous repetition period is $$\frac{PI\,(MIT - IOT)}{TJ - IOT};$$

and when TJ lies above said range, said asynchronous repetition period is $$\frac{PI\,(MIOT + IOT)}{PI + IOT - TJ} - MIOT.$$

* * * * *